United States Patent [19]

Braun

[11] 4,093,101

[45] June 6, 1978

[54] PARTITIONED PLASTIC CASE

[76] Inventor: Bernard Braun, 834 Moore St., Woodmere, N.Y. 11598

[21] Appl. No.: 827,468

[22] Filed: Aug. 25, 1977

[51] Int. Cl.[2] ..... B65D 1/36; B65D 25/04; B65D 25/06

[52] U.S. Cl. ..... 220/22; 220/21; 220/223

[58] Field of Search ..... 220/20, 21, 22, 22.1, 220/22.2, 22.3

[56] References Cited

U.S. PATENT DOCUMENTS

| | | | |
|---|---|---|---|
| 3,055,531 | 9/1962 | DeChelbor | 220/21 |
| 3,107,026 | 10/1963 | DeChelbor | 220/21 |
| 3,353,703 | 11/1967 | Bartoo | 220/21 |
| 3,353,704 | 11/1967 | Belcher | 220/21 |
| 3,820,679 | 6/1974 | Schweitzer | 220/22.3 |

FOREIGN PATENT DOCUMENTS

| | | | |
|---|---|---|---|
| 713,902 | 7/1965 | Canada | 220/21 |
| 892,677 | 2/1962 | United Kingdom | 220/22.3 |

*Primary Examiner*—George E. Lowrance
*Attorney, Agent, or Firm*—Cesari and McKenna

[57] ABSTRACT

A plastic case for containing beverage bottles has partitions which are molded in situ when the case is formed. The partitions can be removed and replaced selectively to permit the case to accommodate various bottle pack configurations. When the partitions are replaced, resilient tabs formed integrally with the partitions engage projections formed in the case bottom wall to securely anchor the partitions to the bottom wall, while clips may be used to reconnect the partitions to each other and to the case side walls. Several such cases can be arranged vertically in a special rack for display and dispensing purposes.

16 Claims, 9 Drawing Figures

PARTITIONED PLASTIC CASE

BACKGROUND OF THE INVENTION

This invention relates to a plastic case for holding beverage containers such as soft drink containers and the like. It relates more particularly to a case of this type having partitions which are removable and replaceable selectively to permit the case to accommodate the various bottle pack configurations presently in use.

Plastic cases are used to protectively enclose frangible containers when they are being transported from the bottler to the supermarket or other point of retail sale. Such cases are made of a suitable impact resistent plastic such as high density polyethylene and they are rugged so that they can be returned to the bottler and be reused a number of times.

The dimensions of such plastic cases depend upon the size and number of bottles which the particular case is intended to accommodate. A typical case may have room for twelve quart size bottles. Another case might be sized to contain six 2-liter bottles. Although there are some cases that do not have any interior partitioning, it is generally advisable to provide partitioning within the case in order to separate the individual bottles so that they cannot impact against one another during handling. Thus many present day cases have partitioning that divides the case interior into equal-size compartments for accommodating, say, twelve quart bottles or six 2-liter bottles. Usually the partitions are formed integrally with the case during a single molding operation.

Such cases do accommodate and protect individual bottles quite nicely. However there has been a growing tendency to merchandise soft drinks in multiple-pack containers. In other words, the bottler might group two 2-liter bottles together in a plastic or fibreboard carton or wrap to form a "two-pack". Alternatively the bottler may wish to distribute a group of four such bottles as a four pack. Of course, all the while the bottler wants to retain the option of distributing individual bottles. It is apparent then that the merchandizing of beverage containers in different pack configurations raises certain handling and transportation problems.

More particularly, the containers must be transported in plastic cases whose interior partitioning is compatible with the pack configuration of the bottles in that case. For example, if the above described six-bottle case is to accommodate two single bottles and one four pack, one transverse partition and two-thirds of the longitudinal partition must be removed from the case in order for it to receive the four pack. On the other hand, in order to accommodate four single bottles and one two-pack, one-third of the longitudinal partition must be omitted.

The problem is made more difficult because the bottler never knows which pack configuration will prove popular at any given time in any given area. Resultantly he must maintain an inventory of cases having different interior partitioning configurations to accommodate the various container packs described above. Needless to say, this greatly increases the bottler's warehousing and distribution costs. To avoid these problems the bottler may opt to provide no partitioning at all in any case. In that event, however, the cases do not adequately protect individual bottles which are now free to impact against one another during handling.

Some attempts have been made to provide cases with removable and replaceable partition structure. However, they have not proven to be practical in use. Invariably the partitions are formed separately from the case per se, greatly increasing the molding costs and making the case more expensive to produce. Further, many of these prior cases require special clips and fasteners to reanchor the partitions to the case bottom. These are not only difficult to manipulate but also they are frequently lost. Such prior cases are shown, for example, in U.S. Pat. Nos. 3,200,988, 3,055,531 and 3,353,704.

Prior cases are disadvantaged also because they are difficult to arrange in an eye-pleasing array for display and distribution purposes at the point of sale. Consequently the prior practice has been to remove the bottles from the cases and to place them on shelves or racks in the store which practice further increases handling costs and the incidence of breakage.

SUMMARY OF THE INVENTION

Accordingly the present invention aims to provide a partitioned plastic case which can accommodate a variety of bottle pack configurations.

Another object of the invention is to provide a plastic case which protectively encloses individual containers as well as multiple container packs.

A further object of the invention is to provide plastic case partitioning which is not only removable, but replaceable in different partition configurations.

Yet another object of the invention is to provide a plastic case having removable and replaceable partitioning which is formed in situ with the case in a single molding operation.

A further object of the invention is to provide a plastic case with removable and replaceable interior partitioning that can be disconnected and then reconnected to the case bottom wall without any additional fasteners or fixtures.

Another object of the invention is to provide a partitioned plastic case which is shaped and arranged to be positioned in a rack for display and dispensing purposes.

Other objects will, in part, be obvious and will, in part, appear hereinafter. The invention accordingly comprises the features of construction, combination of elements and arrangement of parts as exemplified in the following detailed description and the scope of the invention will be indicated in the claims.

Briefly my case is generally rectangular and is made of a suitably rugged, impact resistent plastic such as high density polyethylene. The space inside the case is subdivided by longitudinal and transverse partitions and these partitions are formed in situ with the case in a single molding operation. The specific dimensions of the case and the number and placement of the partitions depend upon the size and number of containers to be placed in the case. For example, there are cases which hold twenty-four 6½ to 16-ounce bottles. In most cases, the partitions are arranged to form four rows of six compartments each. There are other cases designed to hold twelve quart bottles, their partitions being positioned to form three rows of four compartments each. Still other cases have interior partitions arranged to form two rows of three compartments each, sized to contain six 2-liter bottles.

The case has the usual rectangular side and end walls joined together at the corners of the case and interconnected by an integral grid-like bottom wall that is customarily used in such cases to save material and assure adequate drainage from the case. Also, appropriate handles are formed in the end walls of the case to facilitate carrying the case and its contents. Further, integral, upstanding box girders are molded into the corners of the case to strengthen the case and make it more resistent to racking. The lower ends of the box girders are spaced above the bottom of the case and are open so that the case can be retained in a special beverage display and dispensing rack to be described in detail later.

The subject case has unusual versatility in that its interior partitions can be removed selectively and even replaced selectively so that the case can accommodate beverage containers arranged singly or in the various different pack configurations in use. For illustrative purposes we will describe the invention in the context of a case capable of accommodating six 2-liter bottles arranged in two rows of three bottles each. In other words, the case has a single longitudinal partition and a pair of spaced-apart transverse partitions dividing the case into six equal compartments. It is customary for bottlers to distribute bottles of this size individually, as well as in a pack consisting of two such bottles retained side by side by a plastic or fibreboard carton or wrap. They may also distribute 2-liter bottles in a four pack consisting of two rows of two bottles each.

The present case, as a result of its special, removable and replaceable partitioning, is able to accommodate any combination of individual bottles or packs totalling six bottles. In other words, the partitions in the present case can be arranged so that the case can hold six individual bottles or two individual bottles and a four pack or four individual bottles and a two pack or one four pack and one two pack, etc. As a consequence, a single case is able to satisfy the entire needs of the bottler distributing 2-liter containers; he need no longer maintain inventories of different cases that are only capable of accommodating a single container pack arrangement. Yet the present partitioned case can be molded in one piece in a single molding operation. Therefore the cost of making the case is kept to a minimum.

The partitions are able to be molded integrally with the remainder of the case, yet are removable and replaceable without requiring any special fasteners or fixtures because of the special structure connecting the bottom edges of the partitions to the case bottom wall during the molding operation. More particularly, each connection between a partition and the bottom wall is comprised of a narrow tab projecting down from the bottom of the partition through an opening in the case bottom wall. The lower end of the tab is connected to opposite side edges of that opening by way of upwardly-outwardly oriented webs. In cross-section then, the tab and webs are shaped more or less like a downwardly pointing arrow. Directly below the points of connection of the webs to the bottom wall are formed a pair of flat coplanar projecting surfaces for reasons to be described presently.

During the molding operation, the partitions are also formed with connections to the case side and end walls and to each other near the tops of the partitions. Each connection of a partition to the case comprises a laterally extending tab having a pair of closely spaced-apart, vertically oriented, elongated ribs adjacent the case wall. The connections between the longitudinal partition and the transverse partitions comprise lateral tabs molded integrally with the longitudinal partition on each side of a transverse partition with each tab having a similar rib spaced slightly away from the corresponding transverse partition.

Altering the fully partitioned, six compartment case to accommodate different pack configurations involves breaking the connections between the partitions themselves and between partitions and the case walls. More particularly, the connections to the case side and end walls are broken by vertically sawing or cutting the tab connecting those parts at a location between the ribs. Likewise, the connections between the partitions are severed by sawing or cutting their connecting tabs at a location between the rib and the adjacent transverse partition. Finally, the partitions are separated from the case bottom wall by cutting and sawing the connector webs right at the boundary or junction of those webs with the case bottom wall. Thus by severing the appropriate tabs and webs, one may remove one-third of the longitudinal partition so that the case can contain four individual bottles and one two-pack. Alternatively, two-thirds of the longitudinal partition and one transverse partition can be removed so that the case can accommodate one four pack and two individual bottles. As a further example, all of the partitions can be removed so that the case can accommodate one four-pack and one two-pack or three two-packs.

Under certain circumstances, it may be desirable to replace some or all of the previously removed partitions to enable the case to accommodate more individual bottles. In this event, one or more of the partitions are replaced in the case at their original locations. The oblique webs, still attached to the tabs at the bottoms of the partitions, are forced downwards until their ends engage under the projecting surfaces just below the original connection of the webs to the case bottom wall. The webs are somewhat resilient so that they tend to resume their original orientation and actually pull the replaced partitions down against the case bottom wall and thus firmly anchor them in place.

Reconnection of the ends of the partitions to each other and to the case side and end walls may be accomplished, if desired, by means of metal or plastic clips engaging over the ribs still present at the ends of the severed partition structure and at the original connecting locations on the case walls and the remaining transverse partition. Actually, the reconnection of the partitions to the case bottom wall is all that is required to firmly reanchor the partitions. The reconnection to the case side and end walls is only done to preserve the vertical orientation of the partitions.

Of course once the partition structure has been replaced, the case can be modified further to accommodate different pack arrangements by removing or replacing appropriate partitions in the same manner described above.

Thus the ability to mold the partitions and case walls together using a single pair of male and female dies in a single molding operation minimizes the cost of making the subject case. Further, the fact that the partition structure can be removed and then subsequently reconnected to the case bottom wall without using any special fasteners or fixtures means that the same case can be modified readily to accommodate a variety of different container pack configurations. This results in further economies for the bottler who is not longer required to inventory a number of differently-partitioned cases to suit his changing marketing requirements.

BRIEF DESCRIPTION OF THE DRAWINGS

For a fuller understanding of the nature and objects of the invention, reference should be had to the following detailed description taken in connection with the accompanying drawings, in which.

DESCRIPTION OF THE PREFERRED EMBODIMENTS

Figure 1:
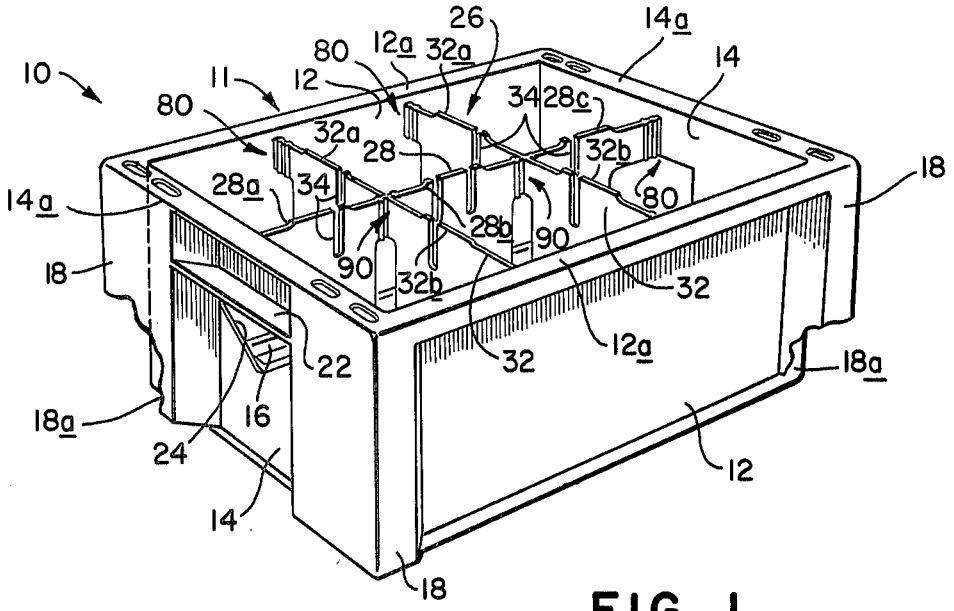
FIG. 1 is a perspective view of a plastic case having removable, replaceable partitions, made in accordance with this invention.

Turning now to FIG. 1 of the drawings, the subject partitioned case shown generally at 10 is generally rectangular, being molded in a single molding operation of a suitable strong, impact resistent material. The case includes a generally rectangular outer shell shown generally at 11 consisting of a pair of identical side walls 12 and a pair of identical end walls 14 and a grid-like bottom wall 16 extending between the side and end walls.

Four identical box grinders 18 are formed at the corners of shell 11. Each box girder 18 is hollow as indicated in FIG. 1 and its lower end 18*a* is open. Box girders 18 strengthen the case and facilitate retaining it in a rack to be described later. A horizontal rib 22 extends between the box girders 18 at each end of the box which serves as a handle for the case. An appropriately shaped opening 24 is provided at each end wall 14 just below rib 22 to accommodate the fingers of the person carrying the case. Each end wall 14 also has a lip 14*a* extending all along its upper edge between box girders 18. Similar lips 12*a* extend along the top edges of the side walls 12. These lips 12*a* and 14*a* connected by the box girders 18 form a continuous rectangular hoop which rigidifies and strengthens the case and together with the box girders make it more resistent to racking.

Formed integrally with shell 11 during the same molding operation is an internal partition structure shown generally at 26. In the illustrated case embodiment, the structure divides the case into six equal compartments arranged in two rows of three compartments each. This is a typical partition configuration used when the case is designed to accommodate six individual 2-liter beverage containers. A case intended to hold a different number of or differently sized containers would have, of course, a different internal partition configuration.

Figure 4:
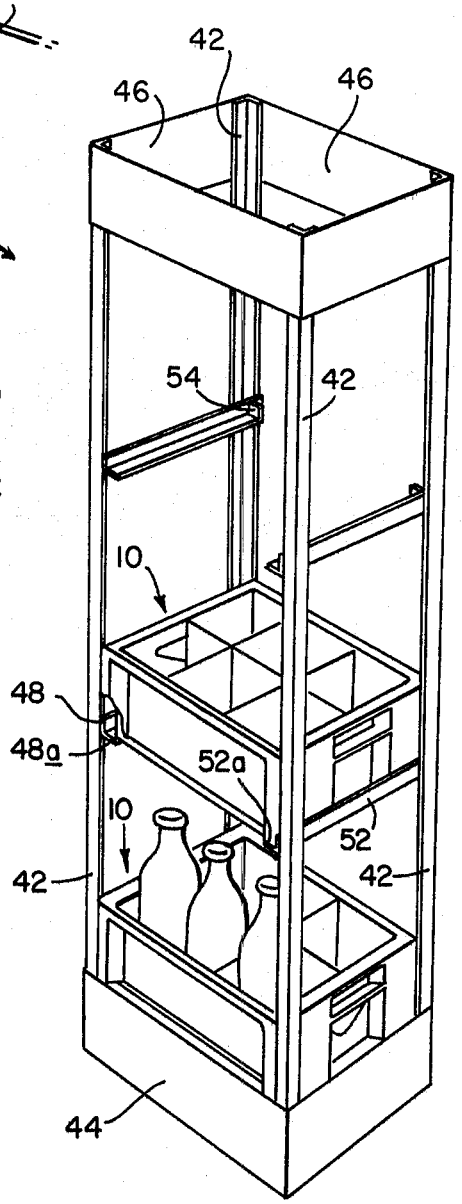
FIG. 4 is a perspective view of a rack designed to retain a plurality of the FIG. 1 cases for display and dispensing purposes.

The beverage containers project above the top of the case as illustrated in FIG. 4 so that one case can be stacked upon the crowns of the containers in an underlying case as is commonly done in the industry.

The partition structure 26 comprises a single longitudinal partition 28 that extends between the case end walls 14 midway across the case. The longitudinal partition is divided into three sections 28*a*, 28*b* and 28*c* by two transverse partitions 32 that extend between the case side walls 12 at equally spaced locations from the case end walls 14. Each of these partitions is composed of sections 32*a* and 32*b* on opposite sides of partition 28. The partitions 28 and 32 are all molded in situ within shell 11 at the same time the shell 11 is formed so that they are integral with each other and with the walls of shell 11.

When the plastic in the newly formed case sets following the actual molding operation, it may undergo some shrinkage. The partitions 28 and 32 being relatively thin tend to set first. Then when the shell 11 cools and contracts, it tends to cause the partitions 28 and 32 to become bowed or warped. To avoid this problem, a series of relatively small, vertical slots 34 may be formed at the tops of the partitions 28 and 32 near where those partitions intersect to permit lengthwise compression of the partitions when shell 11 contracts.

Referring now for a moment to FIG. 4, the cases 10 are particularly adapted to be retained in a storage and display rack indicated generally at 40. Rack 40 comprises four upstanding standards 42 in the form of angle irons which project up from a rectangular base 44. The tops of standards 42 are interconnected by sheet metal straps 46 to form a generally rectangular parallelopiped.

A series of vertically spaced pairs of rails 48 and 52 extend between the front and rear standards 42 at opposite sides of rack 40. The ends of the rails 48 and 52 are connected to the standards by any suitable means such as by welds or bolts. Rails 48 and 52 are also angle irons and they are oriented so as to have legs 48*a*, 52*a* projecting inward from standards 42 to form a pair of tracks. The rear end portion of each of these legs is cut or separated from its adjacent vertical leg and is bent upwardly forming an upstanding tab 54. Each pair of rails 48 and 52 is intended to support a single case 10 horizontally or inclined relative to the ground.

To place a case 10 in the rack, the case is set on the rails so that the rail legs 48*a* and 52*a* engage under the lower ends of the box girders 18 on the case. The case is slid rearwardly on the rails until the rearmost and wall 14 engages tabs 54. Then the rear end of the case is lifted up slightly and shifted back so that the tabs 54 project into the lower ends of the box girders 18 at the rear of the rack. There is sufficient clearance between the edge of each tab 54 and the adjacent vertical rail leg to accommodate the thickness of the box girder wall. The engagement of the case over the tabs prevents the case from being inadvertently knocked or pulled out of the rack 40.

The illustrated rack 40 is able to accommodate three cases 10. Obviously the same principles can be utilized to build taller racks or side-by-side racks to accommodate a large number of cases. Adequate space should be left between the adjacent pairs of rails 48 and 52 to permit the contents of the cases to be seen and be removed easily by the purchasers. Of course when a case is emptied, it is easily removed from the rack and replaced by disengaging it from tabs 54 and sliding it forwardly on the rails.

Figure 2A:
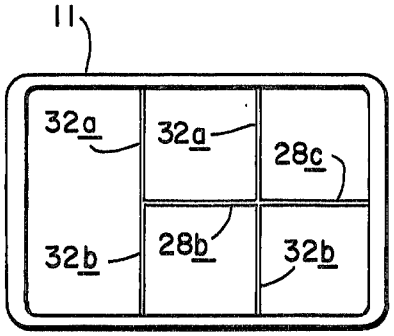
FIGS. 2A to 2C are top plan views of the FIG. 1 case on a smaller scale illustrating different possible partition arrangements.
Figure 2B:
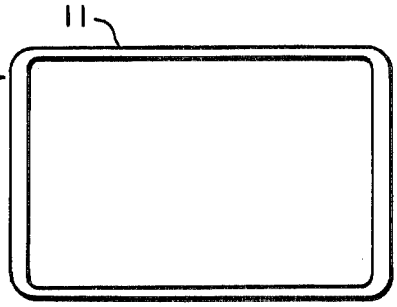
Figure 2C:
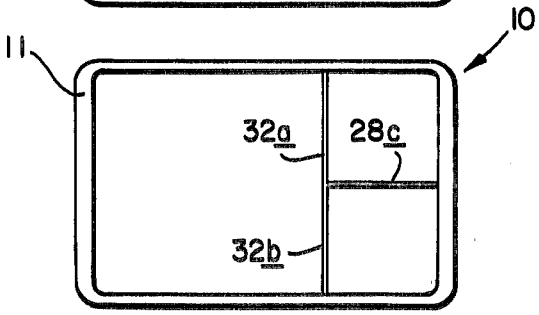

In accordance with this invention, the partition structure 26 in the FIG. 1 case, which is designed to accommodate six individual bottles, can be altered as in FIG. 2A so that the case can accommodate four individual bottles and a two-pack or as in FIG. 2B to permit the case to hold one four-pack and one two-pack or as shown in FIG. 2C to allow the case to hold two individual bottles and one four-pack, or so the case can accommodate other pack configurations totalling six bottles.

Furthermore, this can be accomplished without requiring any special fixtures or fasteners to reconnect the partitions to the case bottom wall.

Figure 3:
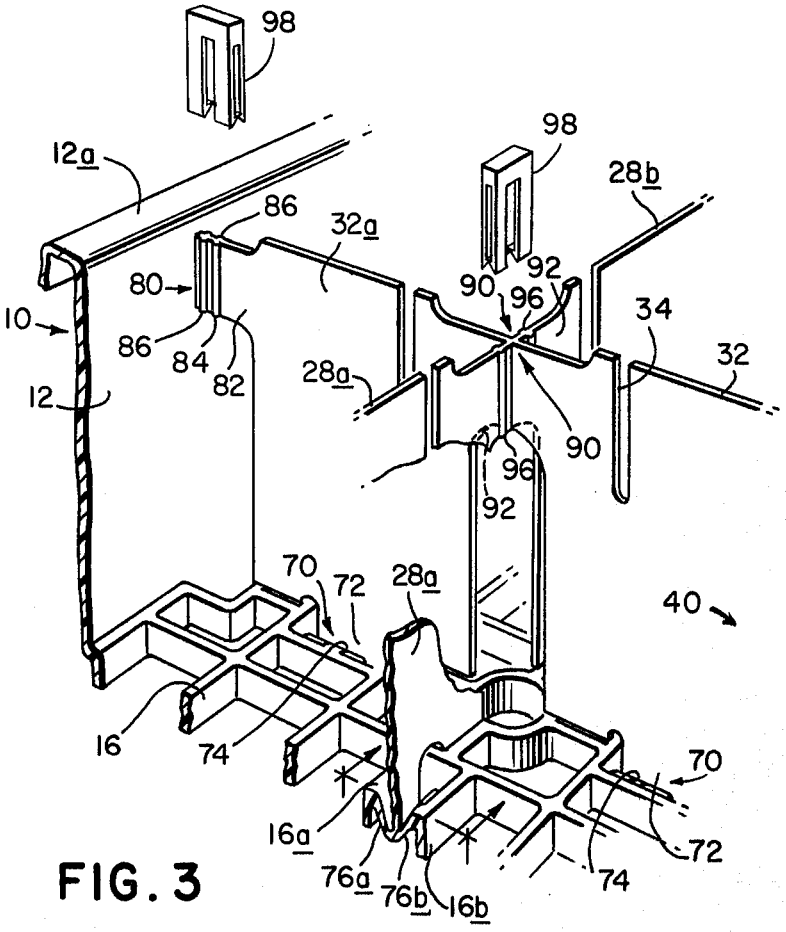
FIG. 3 is a fragmentary sectional view on a much larger scale illustrating the partition-connecting structure in greater detail.

Referring to FIG. 3, each partition section is anchored to the case bottom wall 16 by a specially-shaped, molded in situ connection shown generally at 70. More particularly, each such connection 70 includes a relatively narrow rectangular tab 72 projecting from the bottom edge of the partition section, e.g. section 28*a* in FIG. 3. The tab 72 extends down through a rectangular opening 74 forward in the grid-like case bottom wall 16. The lower edge of tab 72 is connected to the spaced-apart, parallel bottom wall ribs 16*a* and 16*b* defining opening 74 by means of a pair of similar webs 76*a* and 76*b* extending in opposite directions from the lower edge of tab 72 upwardly and outwardly to the top edges of ribs 16*a*, 16*b* respectively. Thus the tab 72 and webs 76*a*, 76*b* in cross-section have the general shape of a downwardly pointing arrow as best seen in 3A.

Figure 3A:
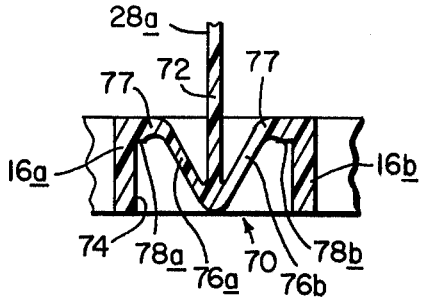
FIG. 3A is a sectional view of a partition section along line 3*a*—3*a* of FIG. 3 on a still larger scale.

Still referring to FIG. 3A, the bottom wall ribs 16*a* and 16*b* are also formed with flat horizontal surfaces 78*a* and 78*b* projecting toward one another just below the boundaries or junctions 77 between the webs 76*a*, 76*b* and their respective ribs. These projecting surfaces 78*a* and 78*b* cooperate with the webs to reconnect the partition sections to the case bottom wall as will be described later. There may also be other connections between the partitions and the case bottom wall that may be permanently severed when a partition is removed. It is important to appreciate at this point, however, that the connections between the partitions and the case bottom wall are specifically designed so that the entire partitioned case can be formed with a single pair of male and female dies in a single molding operation and so that the molded case can be removed easily from the dies. In other words, tab 72 and webs 76*a* and 76*b* and the case bottom wall ribs 16*a* and 16*b* are all formed at the same time by a male die portion projecting into a female die portion and these die portions can be separated easily after the plastic sets leaving the finished partition-case bottom wall connection 70.

Referring now to FIGS. 1 and 3, all the partition sections except section 28*b* are also connected at 80 to the case side and end walls 12, 14. These connections are substantially identical. FIG. 3 shows the connection 80 between section 32*a* and side wall 12 in detail. It comprises a laterally extending tab 82 that projects from the side edge of the partition section 32*a* near the top thereof and is joined to the inner face of the case wall 12. Each tab 82 is formed with a pair of vertical, spaced-apart elongated ribs 84 and 86 on each side of the tab adjacent the junction of the tab and the case wall. These ribs facilitate resecurement of the partition sections to the case walls as will be described later.

There are additional connections seen generally at 90 between the partition sections themselves. More particularly, the longitudinal partition sections 28*a* and 28*b* have laterally extending tabs 92 projecting toward and joined to the transverse partitions 32 at the tops thereof. One such connection 90 is detailed in FIG. 3. Each tab 92 is formed with a pair of vertically oriented elongated ribs 96 spaced somewhat from the adjacent transverse partition 32. These ribs also facilitate reconnection of the partition sections.

When it is desired to remove a partition section or an entire partition, this is accomplished by cutting one or another of the tabs 86, 92 and one or another of the pairs of webs 76*a* and 76*b*. Thus, for example, if it is desired to modify the partition structure in the FIGS. 1 and 3 case as in FIG. 2A to permit it to accommodate four single containers and a two-pack, the longitudinal partition section 28*a* is removed. This is accomplished by cutting or sawing tab 86 connecting section 28*a* to end wall 14. The cut is made between bosses 84 and 86 which provide a certain amount of guidance for the cut. Next, the tab 92 connecting section 28*a* to the transverse partition 32 is cut along a line between the transverse partition 32 and the adjacent pair of ribs 96. Finally, the webs 76*a* and 76*b* joining partition section 28*a* to the case bottom wall 16 are cut at junctions 77 of those webs with the bottom wall ribs 16*a* and 16*b* as best seen in FIG. 3A. Any other connections between 28*a* and wall 16 are also severed. Now the partition section 28*a* can be removed from the case shell 11 permitting a two pack to be inserted at the left hand end of case 10.

Figure 3B:
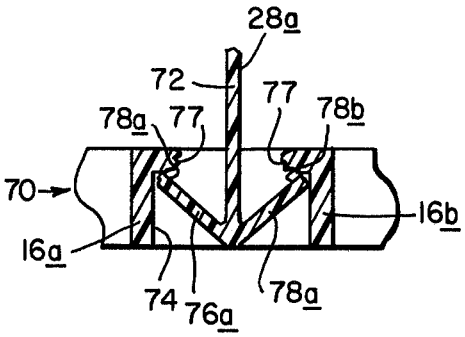
FIG. 3B is a similar view of the same partition section after removal and replacement of that section.

If for some reason it is now desired to replace the partition section 28*a* so that the same case can again accommodate six individual bottles, the partition section 28*a* is placed in its original position with its tab 72 projecting down into opening 74 in the case bottom wall. Then the webs 76*a* and 76*b* are pressed downward so that their free ends engage under the projecting surfaces 78*a* and 78*b* on ribs 16*a* and 16*b* respectively as shown in FIG. 3B. These webs are resilient so that they tend to resume their normal unstressed positions illustrated in FIG. 3A. Consequently they pull downward on tab 72 thereby securely reanchoring the partition section 28*a* to the case bottom wall 16.

This connection is quite sufficient to retain the partition section in the case shell 11. However to assure that the section is oriented properly within the case, the tabs 82 and 92 may, if desired, be reconnected to the case end wall 14 and transverse partition 32 respectively. This is accomplished by means of a metal or plastic clip 98 shown in FIG. 3 which is pressed down over the edge of the partition section and engages around bosses 84 and 86 to rejoin the tab 82 to the case end wall. FIG. 3 specifically shows the connection between the partition section 32*a* and the case side wall 12. However, the end wall connection is substantially the same.

A similar clip 98 is pressed down onto the tab 92 adjacent partition 32. The clip engages around the ribs 96 on opposite sides of partition 32 thereby reconnecting the partition section 28*a* at partition 32. It should be understood that while it is desirable to use the clips 98 to reconnect the sides of the partition sections, this is not absolutely necessary because the connections between the partitions sections and the case bottom wall suffice to securely anchor the sections to the bottom wall.

In the event that it again becomes necessary to remove the partition section 28*a*, the clips 98 can be removed and the webs 76*a* and 76*b* squeezed together as the partition section 28*a* is pressed toward the bottom of the case. This permits the ends of the webs 76*a* and 76*b* to be disengaged from under the projecting surfaces 78*a* and 78*b*, freeing the partition section.

Figure 5:
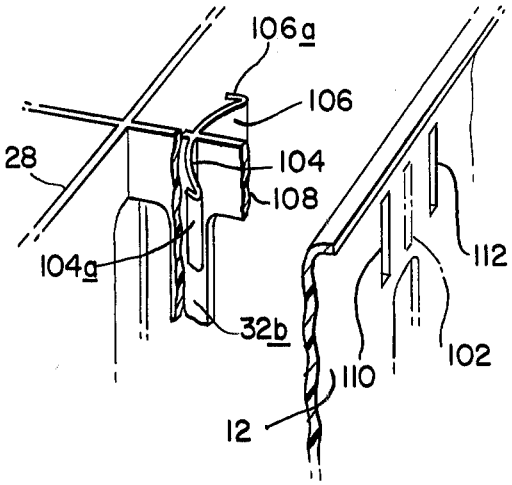
FIG. 5 is a diagrammatic view showing a modified connection between the partitions and the case side walls.

A modified connection between the partitions and the case side wall is illustrated in FIG. 5. As shown there, a transverse partition section 32*b* is molded in situ between longitudinal partition 28 and the case side wall 12, the connection point to the inside of the wall being at 102. Flexible and resilient arms 104 and 106 molded as part of section 32*b* extend laterally from opposite sides of that section toward wall 12. These arms may be curved as shown or straight and their ends terminate in flexible and resilient barbs 104*a* and 106*a* respectively.

Section 32*b* can be separated from the case wall 12 by a saw cut that separates the partition end 108 from connection point 102. Moreover, the partition section 32*b* can be reconnected to the side wall 12 by pressing the arms 104 and 106 together and forcing the barbs 104*a* and 106*a* into slots 110 and 112 formed in the wall 12 on opposite sides of connection point 102. The slots are made slightly undersized so that the barbs have to be flexed somewhat toward their respective arms in order to be squeezed through the slots.

Upon passing through the slots 110 and 112, the barbs 104*a* and 106*a* spring back to their unstressed positions thereby locking the arms in the wall 12. The tension in the arms thereupon draws the partition section end 108 against point 102 and holds it in that position even though the case is handled roughly in use.

It will thus be seen from the foregoing that various ones or all of the partition sections 28*a*, 28*b* and 28*c* and one or both of the transverse partitions 32 can be removed and replaced as desired to permit the case 10 to accommodate individual bottles, two-packs or a four-pack in any combination that will place a total of six bottles in the case. Accordingly the same case can be used in different areas requiring different container pack configurations. Furthermore, the various partition sections can be reanchored to the case bottom wall without requiring any special fixtures or fasteners that could become lost and are difficult to install. Yet the entire partitioned case can be formed in a single molding operation so that manufacturing costs are kept to a minimum.

It will thus be seen that the objects set forth above, among those made apparent from the preceding description, are efficiently attained and certain changes may be made in the above construction without departing from the scope of the invention. For example, the retaining tabs 54 in FIG. 3 can be located at the front ends of the rails 52 and engage in the box girders 18 at the front of the case. Also the rack 40 can be made two or three cases deep. Then inclining the rails relative to the ground would not only make the contents of the cases move visible, but also would make it easier to pull cases at each level of the rack forward as product is emptied out of the forwardmost case at each level. Further, the clips 98 (FIG. 3) can be modified so that they connect between the ribs 96 on the replaced partition section 28*a* and the partition 32 itself instead of the ribs 96 on the opposite side of that partition. Thus, it is intended that all matter contained in the above description or as shown in the accompanying drawings be interpreted as illustrative and not in a limiting sense.

It is also to be understood that the following claims are intended to cover all of the generic and specific features of the invention herein described.

I claim:

1. In a molded plastic case having a pair of spaced-apart side walls, a pair of spaced-apart end walls and a bottom wall connected together to form a generally rectangular shell, the improvement comprising a partition structure molded in situ in the shell at the time the shell is formed, said partition structure including A. one or more partition sections extending generally perpendicular to the case bottom wall, and B. means formed integrally with each partition section and the case bottom wall connecting the partition section to the case bottom wall, said connecting means comprising 1. means defining an opening in the case bottom wall,
2. a tab projecting from the bottom edge of the partition section into said opening,
3. a pair of webs extending in opposite directions from the lower edge of said tab to the opposite edges of said opening near the top thereof, and
4. a pair of projecting surfaces located in the bottom wall just below the junctions of the webs and the adjacent opening edges, said surfaces extending toward one another and being substantially coextensive with said webs so that after the juntions between the webs and the opening edges are broken to free the partition section from the shell, the webs can be flexed so that their free ends resiliently engage under the projecting surfaces and re-anchor the partition section to the bottom wall.

2. The case defined in claim 1 wherein the tab and webs in cross-section have the general shape of a downwardly directed arrow.

3. The case defined in claim 1 and further including means for removably connecting the sides of a said partition section to a case side or end wall.

4. The case defined in claim 3 wherein the connecting means include

A. a tab extending laterally from a side edge of the partition to the side or end wall, B. a pair of spaced-apart vertically oriented, elongated ribs adjacent said wall, and C. means for engaging around the ribs after the lateral tab is severed between the ribs to reanchor the partition section to said wall.

5. The case defined in claim 1 wherein the partition structure includes

A. a transverse partition integrally connected between the case side walls,

B. longitudinal partition sections positioned on opposite sides of the transverse partition and extending parallel the case side walls, and C. an integral tab extending between the side edge of each longitudinal partition section and the intervening transverse partition, each said tab having an elongated, vertically oriented rib spaced somewhat from the transverse partition to facilitate resecurement of the partition sections to the facilitate resecurement of the partition sections to the transverse partition after the tabs are severed vertically between the ribs and the transverse partition.

6. The molded plastic case defined in claim 1 and further including one or more vertical elongated slots extending from a horizontal edge of each partition section an appreciable distance through the panel section to relieve longitudinal compression stresses arising in the partition sections when the case shell is formed.

7. A molded plastic case as defined in claim 1 and further including box girders formed integrally with the case shell at the junctions of the case side and end walls, the ends of the box girders adjacent the case bottom wall being open and exposed to receive retainers at the ends of dispensing rack tracks supporting said case.

8. A molded plastic case of the type composed of a generally rectangular shell comprising spaced-apart side and end walls connected together at their ends and having a bottom wall connected between said side and end walls, the improvement comprising A. a plurality of partition sections inside the shell and molded in situ therewith when the shell is formed, B. an opening through the bottom wall of the shell directly below each partition section, C. a relatively narrow tab projecting from the lower edge of each partition section into the adjacent bottom wall opening, D. means formed integrally with the lower edge of each tab and the edges of the corresponding opening for connecting the lower edge of the tab to the upper edge of the opening, and E. means defining one or more projecting surfaces directly below each connecting means so that after the connecting means is broken to release the associated partition section from the case bottom wall, the partition section can be re-anchored to the bottom wall by engaging the connecting means and the surface defining means.

9. The case defined in claim 8 wherein

A. the connecting means comprises a pair of webs extending from opposite sides of the lower end of the tab upwardly and outwardly forming the barbs of an arrow, and B. the projecting surfaces are positioned directly below the junctions of the webs with the bottom wall opening edges.

10. The case defined in claim 9 and further including additional means for detachably connecting the side edges of the partition sections to said shell.

11. The case defined in claim 10 wherein said additional connecting means comprise A. tabs formed integrally with the partition sections and the shell, B. means defining a pair of vertically oriented spaced-apart ribs on each said tab adjacent said shell.

12. The case defined in claim 11 and further including further means for detachably interconnecting said partition sections, said means comprising A. a tab integrally formed between said partition sections and B. a vertically oriented rib on said tab, said rib being spaced somewhat from a partition section to which the tab is connected.

13. The case defined in claim 12 and further including removable clips for engaging over the partition sections and around said ribs.

14. The case defined in claim 3 wherein said removable connecting means include A. a pair of resilient arms projecting laterally from opposite sides of the partition section toward a case side wall, and B. means for removably locking the ends of the arms to the case wall.

15. The case defined in claim 14 wherein the locking means include

A. a pair of slots in the case wall for receiving said arm ends, and

B. means for retaining the ends in the slots.

16. The case defined in claim 15 wherein the retaining means comprise barbs on the ends of the arms.

* * * * *